US010438606B2

(12) United States Patent
Christoph

(10) Patent No.: US 10,438,606 B2
(45) Date of Patent: Oct. 8, 2019

(54) POP NOISE CONTROL

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 16/026,860

(22) Filed: Jul. 3, 2018

(65) Prior Publication Data

US 2019/0019527 A1 Jan. 17, 2019

(30) Foreign Application Priority Data

Jul. 11, 2017 (EP) ..... 17180703

(51) Int. Cl.

| | |
|---|---|
| ***G10L 21/0232*** | (2013.01) |
| ***G10K 11/175*** | (2006.01) |
| ***H04R 3/00*** | (2006.01) |
| *G10L 19/025* | (2013.01) |

(52) U.S. Cl.

CPC ..... *G10L 21/0232* (2013.01); *G10K 11/175* (2013.01); *H04R 3/007* (2013.01); *G10K 2210/1081* (2013.01); *G10L 19/025* (2013.01)

(58) Field of Classification Search

CPC . G10L 21/0232; G10L 19/025; G10K 11/175; H04R 3/007

See application file for complete search history.

(56) References Cited

U.S. PATENT DOCUMENTS

| | | | | |
|---|---|---|---|---|
| 2006/0013413 | A1* | 1/2006 | Sakaidani | H03G 3/348 381/104 |
| 2006/0229869 | A1 | 10/2006 | Nemer | |
| 2010/0223054 | A1 | 9/2010 | Nemer et al. | |
| 2011/0103615 | A1 | 5/2011 | Sun | |
| 2011/0255710 | A1* | 10/2011 | Toyama | H04R 3/007 381/94.4 |
| 2012/0207255 | A1* | 8/2012 | Siemons | H04B 1/1081 375/346 |

OTHER PUBLICATIONS

European Patent Office, Extended European Search Report Issued in Application No. 17180703.5, dated Nov. 7, 2017, Germany, 6 pages.

* cited by examiner

*Primary Examiner* — Andrew L Sniezek
(74) *Attorney, Agent, or Firm* — McCoy Russell LLP

(57) ABSTRACT

Example pop noise removal systems and methods include detecting impulsive components in an input signal based on a signal-to-noise ratio spectrum of the input signal, and generating a spectral pop noise removal mask and applying the spectral pop noise removal mask to the input signal if impulsive components in the input signal are detected, the pop noise removal mask configured to suppress the impulsive components in the input signal, when applied.

17 Claims, 3 Drawing Sheets
(2 of 3 Drawing Sheet(s) Filed in Color)

POP NOISE CONTROL

CROSS REFERENCE TO RELATED APPLICATIONS

The present application claims priority to European Patent Application No. EP17180703 entitled "POP NOISE CONTROL," and filed on Jul. 11, 2017. The entire contents of the above-identified application are incorporated by reference for all purposes.

BACKGROUND

1. Technical Field

The disclosure relates to a system and method (generally referred to as a "system") for pop noise control.

2. Related Art

Common acoustic echo cancellation approaches and common noise reduction approaches are not able to sufficiently remove echoes that arise from impulsive reference signals with a distinct, impulsive bass beat as in music, since such parts of a reference signal are prone to driving a utilized loudspeaker beyond its linear range of operation and thus cause, in sound reproduced by the loudspeaker, unwanted nonlinear components which cannot be controlled or removed, neither by any common acoustic echo cancellation approach nor any common noise reduction approach. A need exists for an effective control of the impulsive parts of noise, which are also known as pop-noise or transient noise.

SUMMARY

An example pop noise control system includes a detector block configured to detect impulsive components in an input signal based on a signal-to-noise ratio spectrum of the input signal, and a masking block configured to generate a spectral pop noise removal mask and to apply the spectral pop noise removal mask to the input signal if impulsive components in the input signal are detected, the pop noise removal mask being configured to suppress the impulsive components in the input signal, when applied.

An example pop noise control method includes detecting impulsive components in an input signal based on a signal-to-noise ratio spectrum of the input signal, and generating a spectral pop noise removal mask and applying the spectral pop noise removal mask to the input signal if impulsive components in the input signal are detected, the pop noise removal mask being configured to suppress the impulsive components in the input signal, when applied.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Reference signals containing distinct impulsive parts, such as pieces of music, are more likely to create in loudspeakers nonlinearities which, as a consequence, cannot be removed, e.g., neither by linear signal processing parts of acoustic echo cancellation (AEC) systems nor by nonlinear residual echo suppression (RES) parts thereof, and, thus, lead to strong remaining impulsive parts in the error signals (forming output signals) of the acoustic echo cancellation systems, irrespective of whether optional residual echo suppression stages in the acoustic echo cancellation systems are enabled or not.

Figure 1:
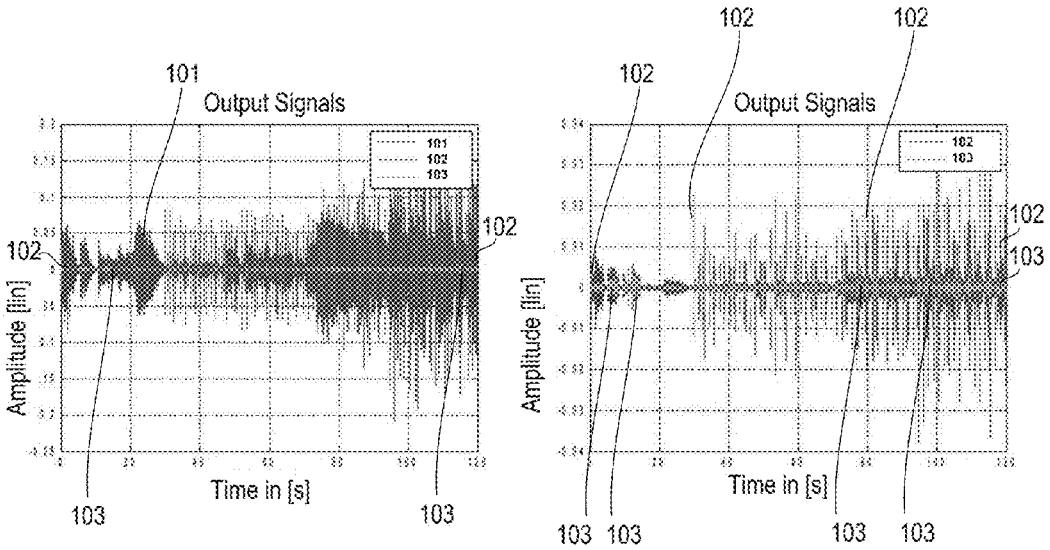
FIG. 1 is an amplitude-time diagram illustrating signals occurring in an acoustic echo cancellation system, including a signal from a microphone, an output signal of a linear acoustic echo cancellation stage, and an output signal of a residual echo suppression stage.

FIG. 1 shows two amplitude time diagrams illustrating graphs of various time signals occurring in an exemplary acoustic echo cancellation system (not shown in FIGS. 1, 2, 4 and 5). In the left hand diagram of FIG. 1, graph 101 depicts a microphone signal, graph 102 an output signal of a linear signal processing part of the acoustic echo cancellation system, and graph 103 an output signal of the residual echo suppression stage of the acoustic echo cancellation system. The graphs are based on recordings that were taken from a miniature loudspeaker mounted in a closed box with a volume of approximately 0.8 [l]. The loudspeaker was driven at a high level with the renowned song "Hotel California" from the band "The Eagles". Towards about 30 [s] elapsed time, the impulsiveness of this song emerges. In the right hand diagram of FIG. 1, the output signal of the linear acoustic echo cancellation stage (graph 102) and the output signal of the residual echo suppression stage (graph 103), the threshold of which was set to 20 [dB], are shown in detail.

When comparing the total level of the recording signal to the error signal, it can be seen that impulsive parts of the song (elapsed time>30 [s]) are by far less suppressed by the linear acoustic echo cancellation stage than parts showing a much less distinct impulsive character (elapsed time<30 [s]). In contrast to the linear acoustic echo cancellation stage, the residual echo suppression stage does not appear to distinguish between different characteristics of the signal, but rather to suppress all signal parts in a similar way. As a result, even in the output signal of the residual echo suppression stage, the error signal still shows a considerable difference between quasi-stationary signal parts and impulsive signal parts. It should be noted that remaining signal parts that can be observed within the initial 15 [s] represent speech signals that should be freed of echoes.

Figure 2:
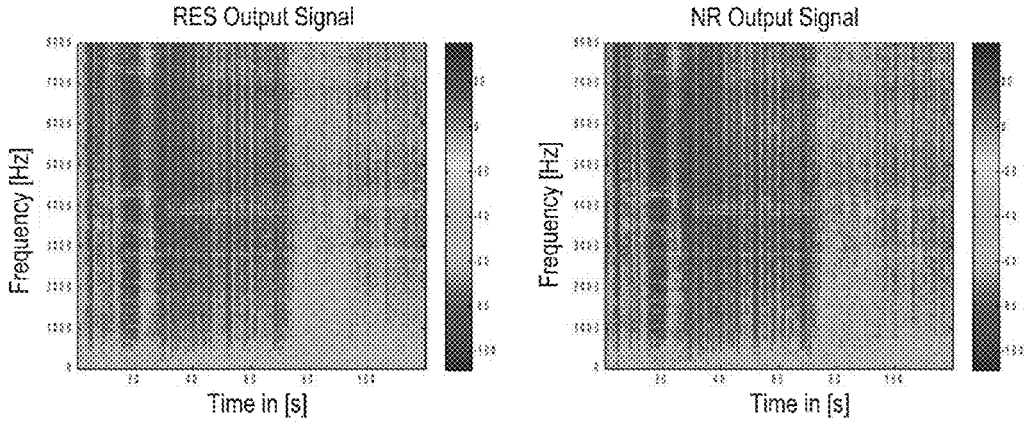
FIG. 2 shows spectrograms of the output signal of the residual echo suppression stage (on the left) and of the output signal of the noise reduction stage without any pop-noise-removal weighting mask applied (on the right).

Applying (only) common single-channel noise reduction may not overcome the drawback outlined above, as can be seen from FIG. 2, as single-channel noise reduction stages may be restricted to reducing noise parts which do not change too quickly over time, but not impulsive signal parts as in the above example. FIG. 2 shows spectrograms of the output signal of the residual echo suppression stage (left side) and of the output signal of a noise reduction stage following the residual echo suppression stage, in which no pop-noise was removed (right side).

Figure 3:
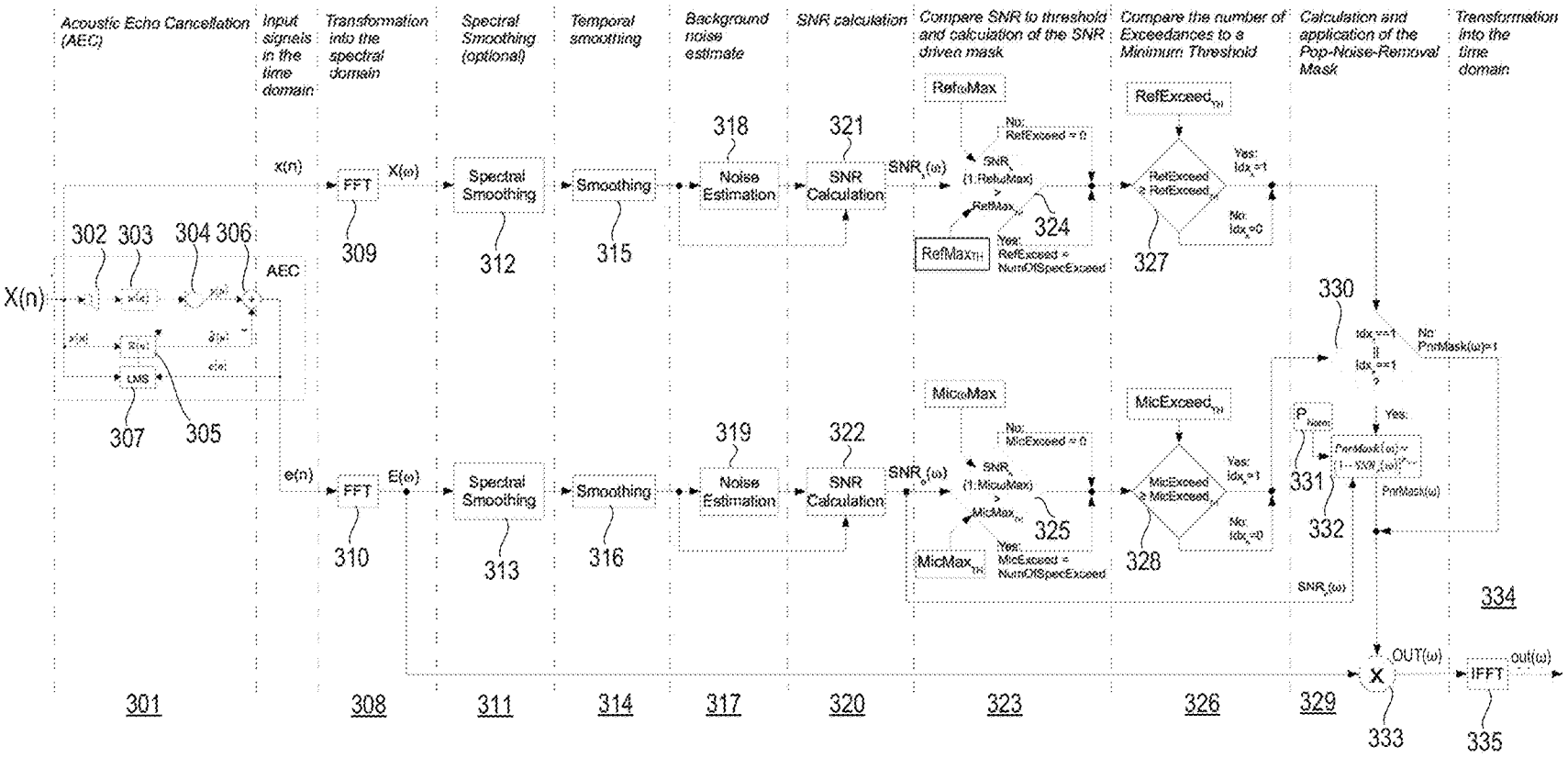
FIG. 3 is a schematic diagram illustrating the structure of an exemplary pop noise control system executing an exemplary pop noise control method.

FIG. 3 is a schematic diagram illustrating the structure of and the signal flow in an exemplary pop noise control system (method) which determines (calculates) and applies a pop noise removal (PNR) mask for removing pop-noise parts driven by the impulsive parts of the reference signal, such as music, as well as microphone signal based pop-noise parts that may occur if one knocks on the microphone. The pop noise control system shown in FIG. 3 is connected to an acoustic echo cancellation stage 301 which executes an acoustic echo cancellation procedure. In the acoustic echo cancellation stage 301, an electrical reference signal x(n) is supplied to a loudspeaker 302 where it is transformed into sound. The sound is transferred via an unknown system 303 having a transfer function w(n) to a microphone 304 where the sound is transformed back into an electrical signal, microphone signal y(n). An adaptive filter 305 having a transfer function $\hat{w}(n)$ is operated in parallel with the unknown system 303, i.e., is supplied with the reference signal x(n) and outputs an estimated microphone signal $\hat{d}(n)$. The estimated microphone signal $\hat{d}(n)$ is subtracted from the microphone signal y(n), e.g., in a subtracter 306, to provide an error signal e(n). The adaptive filter 305 is controlled by a filter controller 307 that receives the reference signal (x) and the error signal e(n) employing, e.g., the known Least Mean Square (LMS) method. Filter coefficients and, thus, the transfer function $\hat{w}(n)$ of the adaptive filter 305 are adjusted by the filter controller 307 in an iteration loop such that the error signal e(n) is minimized, i.e., the estimated microphone signal $\hat{d}(n)$ approaches the microphone signal y(n). The unknown transfer function of unknown system 303 is, thus, approximated by the transfer function of the adaptive filter 305.

The reference signal x(n) and the error signal e(n) form input signals into the pop noise control system, in the present example particularly into a spectral transformation stage 308 of the pop noise control system where they are transformed from the time domain into the spectral domain, i.e., into a spectral reference signal X(ω) and a spectral error signal E(ω), by way of, e.g., two fast Fourier transformation (FFT) blocks 309 and 310. The spectral reference signal X(ω) and the spectral error signal E(ω) are input into an optional spectral smoothing stage 311 for spectral smoothing. The spectral smoothing stage 311 may include two spectral smoothing blocks 312 and 313, one for reference signal based signal processing and the other for error signal based signal processing. Depending on whether the optional spectral smoothing stage 311 is present or not, a temporal smoothing stage 314 is connected to the optional spectral smoothing stage 311 or to the spectral transformation stage 308. The temporal smoothing stage 314 may include two temporal smoothing blocks 315 and 316, one for reference signal based signal processing and the other for error signal based signal processing. Smoothing a signal may include filtering the signal to capture important patterns in the signal, while leaving out noisy, fine-scale and/or rapid changing patterns.

A background noise estimation stage 317 is connected downstream of the temporal smoothing stage 314 and may include two background noise estimation blocks 318 and 319, one for reference signal based processing and the other for error signal based signal processing. The background noise estimation stage 317 may use any known method that allows for determining or estimating the background noise contained in an input signal, e.g., the reference signal x(n) and/or the error signal e(n). In the example shown, the signals to be evaluated, spectral reference signal X(ω) and spectral error signal E(ω), are in the spectral domain so that the background noise estimation blocks 318 and 319, and, thus, the background noise estimation stage 317 are designed to operate in the spectral domain.

In a spectral signal-to-noise ratio determination (calculation) stage 320, the input signals and output signals of background noise estimation stage 317 are processed to provide spectral signal-to-noise ratios, spectral signal-to-noise ratio $SNR_x(\omega)$ for the reference signal x(n) and spectral signal-to-noise ratio $SNR_e(\omega)$ for the error signal e(n). The signal-to-noise ratio calculation stage 320 may include two signal-to-noise estimation blocks 321 and 322, one for reference signal based processing which provides spectral signal-to-noise ratio $SNR_x(\omega)$, and the other for error signal based signal processing which provides spectral error signal-to-noise ratios $SNR_e(\omega)$. For example, the signal-to-noise estimation blocks 321 and 322 may divide the input signal of the corresponding background noise estimation block 318, 319 by the output signal of the respective background noise estimation block 318, 319 to calculate the spectral signal-to-noise ratios $SNR_x(\omega)$ and $SNR_e(\omega)$.

In a first evaluation stage 323, the estimated signal-to-noise ratios in the spectral domain i.e., the multiplicity of signal-to-noise ratios per frequency referred to as spectral signal-to-noise ratios $SNR_x(\omega)$ and $SNR_e(\omega)$, are compared within a frequency band that is totally below a predetermined (adjustable) frequency limit, e.g., an upper reference signal frequency limit RefωMax and an upper microphone signal frequency limit MicωMax, to respective predetermined signal-to-noise ratio thresholds, e.g., a reference signal signal-to-noise ratio threshold $RefMax_{TH}$ and a microphone signal signal-to-noise ratio threshold $MicMax_{TH}$ to determine an integer number of exceedances, e.g., the numbers of exceedances RefExceed and MicExceed, which are set to zero, if the respective current signal-to-noise ratio per frequency, signal-to-noise ratios $SNR_x(\omega)$ and $SNR_e(\omega)$ at a discrete frequency, does not exceed the respective predetermined signal-to-noise ratio threshold, signal-to-noise ratio thresholds $RefMax_{TH}$ and $MicMax_{TH}$. Otherwise, the numbers of exceedances, e.g., the numbers of exceedances RefExceed and MicExceed, will be set to the integer numbers of spectral signal-to-noise ratios that exceed the respective predetermined signal-to-noise ratio thresholds, e.g., signal-to-noise ratio thresholds $RefMax_{TH}$ and $MicMax_{TH}$, wherein the integer number is greater than or equal to one. The first evaluation stage 323 may include two first evaluation blocks 324 and 325, one for reference signal based processing which receives the spectral signal-to-noise ratio $SNR_x(\omega)$ and provides the number of exceedances RefExceed, and the other for error signal based signal processing which receives the spectral signal-to-noise ratio $SNR_e(\omega)$ and provides the number of exceedances MicExceed.

In a second evaluation stage 326, the numbers of exceedances, e.g., the numbers of exceedances RefExceed and MicExceed, are compared to respective minimum thresholds, e.g., minimum thresholds RefExceedTH and MicExceedTH. If the respective number of exceedances, the numbers of exceedances RefExceed and/or the number of exceedances MicExceed, exceeds the minimum threshold, minimum threshold $RefExceed_{TH}$ and/or minimum threshold $MicExceed_{TH}$, a respective comparison value, e.g., value $Idx_x$ and/or value $Idx_e$, is set to a logical state one ('1'), otherwise to a logical state zero ('0'). The second evaluation stage 326 may include two second evaluation blocks 327 and 328, one for reference signal based processing which provides the comparison value $Idx_x$, and the other for error signal based signal processing which provides the comparison value $Idx_e$.

In a third evaluation stage 329, the comparison values $Idx_x$ and $Idx_e$ are checked to determine whether one of them is one ("disjunction") or whether they are both one ("conjunction"). A disjunction ("OR") is used when a maximum suppression of impulsive noise, either in the microphone signal or the reference signal, is desired. A conjunction ("AND") is used when suppression of speech signals is to be avoided. In the exemplary pop noise control system (method) shown in FIG. 3, the disjunction is employed so that, if one of the comparison values is one, then a spectral pop-noise removal mask PnrMask(ω) is set to $(1-SNR_e(\omega))^{P_{Norm}}$, wherein $P_{Norm}$ is the p-norm of the mask and $SNR_e(\omega)$ is the output of signal-to-noise estimation block 322. Otherwise, the pop-noise removal mask PnrMask(ω) is set to one.

The resulting pop-noise removal mask PnrMask(ω) is multiplied in the spectral domain with the spectral error signal E(ω) from FFT block 310 to provide a spectral output signal OUT(ω). The third evaluation stage 329 may include a comparison block 330 for checking the comparison values $Idx_x$ and $Idx_e$ to determine whether at least one of them is one. The third comparison stage 329 may further include a register 331 for storing the p norm $P_{Norm}$, a processing block 332 that calculates $(1-SNR_e(\omega))^{P_{Norm}}$, and a multiplication block 333 for multiplying the spectral error signal E(ω) with the pop-noise removal mask PnrMask(ω). The output signal OUT(ω) in the spectral domain is transformed into an output signal out(n) in the time domain by an inverse spectral transformation stage 334 which may include an inverse fast Fourier transformation (IFFT) block 335.

Although a pop noise control system for two input signals, e.g., reference signal x(n) and the error signal e(n), is described above in connection with FIG. 3, any number of input signals can be processed (e.g., 1, 3, 4 . . . ) by adapting the structure shown accordingly. As can be seen from FIG. 3, in order to successfully remove pop-noise parts, impulsive parts of the reference signal are detected, e.g., by analyzing a signal indicative of an estimated, spectral signal-to-noise ratio in a frequency range up to a predetermined (adjustable), upper reference signal frequency limit RefωMax (which may be equal to an upper microphone signal frequency limit MicωMax, e.g., 100 or 150 or 300 [Hz]) and by counting spectral signal-to-noise ratio values that exceed, within the predetermined frequency range, a predetermined (adjustable) signal-to-noise ratio threshold $RefMax_{TH}$ (or a signal-to-noise ratio threshold $MicMax_{TH}$ of the microphone signal). Every time the number of spectral signal-to-noise ratio values that exceed the signal-to-noise ratio threshold $RefMax_{TH}$ exceeds a predetermined (adjustable) reference signal based minimum number $RefExceed_{TH}$ (or a microphone signal based number $MicExceed_{TH}$) then a spectral pop noise reduction mask (PnrMask(ω)) will be determined (e.g., calculated), otherwise the spectral pop noise reduction mask will be set to neutral, i.e. to one (PnrMask(ω)=1). Finally, the pop noise reduction mask will be applied to the error signal of the acoustic echo cancellation stage which may or may not contain a residual error suppression stage. Further, the determination of the pop noise reduction mask as outlined above may be combined with the determination of a common noise reduction mask in an efficient way that allows for removing both, quasi-stationary as well as impulsive parts, and which also allows for distinguishing between reference signal based pop-noise parts and microphone signal based parts.

An acoustic echo cancellation system that is able to remove reference signal based pop-noise parts may be seen as a nonlinear acoustic echo cancellation system as this system is only active if there is a certain degree of likelihood that the speaker may become nonlinear, and as this system (only) utilizes the lower spectral part of the signal-to-noise ratio for the analysis and for the creation of the pop noise removal mask. In other words, analyzing (only) the lower spectral range of the spectral signal-to-noise ratios and detecting there more than a minimum number of spectral lines that exceed a predetermined maximum threshold gives an indication of whether the excursion of the membrane of the speaker is high. Hence, the possibility that nonlinear by-products, which cannot be canceled by a common acoustic echo cancellation stage, will be part of the error signal, is high. In addition, due to the fact that within this limited spectral range a minimum number of spectral signal-to-noise ratios exceeds a given maximum threshold, the probability is also high that a signal having an impulsive character will be present. This is an indication that a pop noise removal mask should be determined and applied, in order to remove those, otherwise not removable, nonlinear signal parts of the error signal.

The difference between the pop noise removal mask and the noise reduction mask is mainly that the latter will be more or less inverted, by subtracting the given noise reduction mask from one to create the pop noise removal mask. In other words, while the noise reduction mask leaves impulsive signal parts, such as speech, unaffected and aims to suppress quasi-stationary signal parts, the pop noise removal mask is aimed at the opposite, i.e. it aims to suppress distinct impulsive signal parts, while still trying to leave speech signals unaffected. As the latter tries to suppress and restore signal parts with similar properties, it is helpful to limit the analysis to the lower spectral part where usually no speech components are present, for example, at frequencies below 150 [Hz]. In addition, by (optionally) analyzing the reference signal, which is not affected by any useful speech signals, the risk that an undesired suppression of useful speech signals will occur is further reduced.

Microphone signal based pop-noise removal may also rely only on a spectrum of the signal-to-noise ratios in which essentially no useful speech parts may occur, e.g., frequencies below 150 [Hz]. This frequency range is used for the analysis, and only those parts which also show an impulsive character are taken for the determination of the pop noise removal mask. Hence the risk of an erroneous suppression of useful speech signal parts is low, even when taking the microphone signal as input signal of the pop noise removal system and method.

Figure 4:
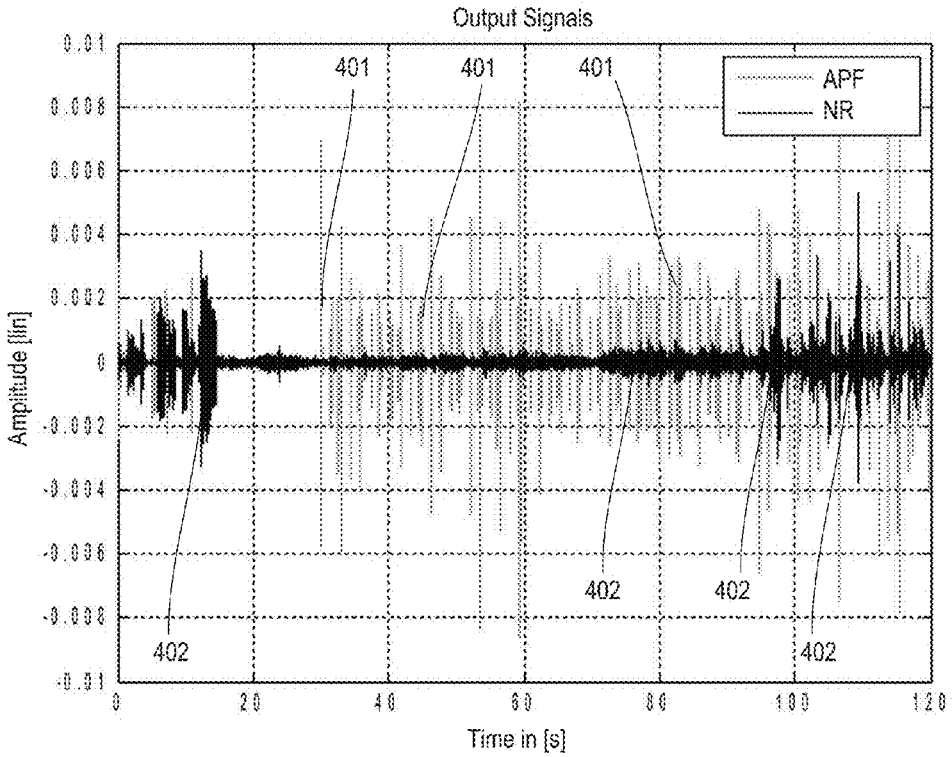
FIG. 4 is an amplitude-time diagram illustrating a comparison of output signals from an adaptive post filter stage and a noise reduction stage.

As can be seen from FIG. 4, which is an amplitude-time diagram of time signals taken from the output of a common acoustic echo cancellation/residual echo suppression system (graph 401) and of the output of an acoustic echo cancellation system employing a pop noise removal mask (graph 402), the useful speech signal, which is present at the first 15 [s] of the signal, remains almost completely unaffected by the pop noise removal mask. Also an acoustical verification revealed an almost indistinguishable acoustical performance in terms of speech quality of the signals output by a common acoustic echo cancellation stage (e.g., the output signal of a residual echo suppression stage) and the signals output by the pop noise control system and method disclosed herein. Looking at the remaining time signal, a very successful suppression of the remaining impulsive disturbances can be seen.

Figure 5:
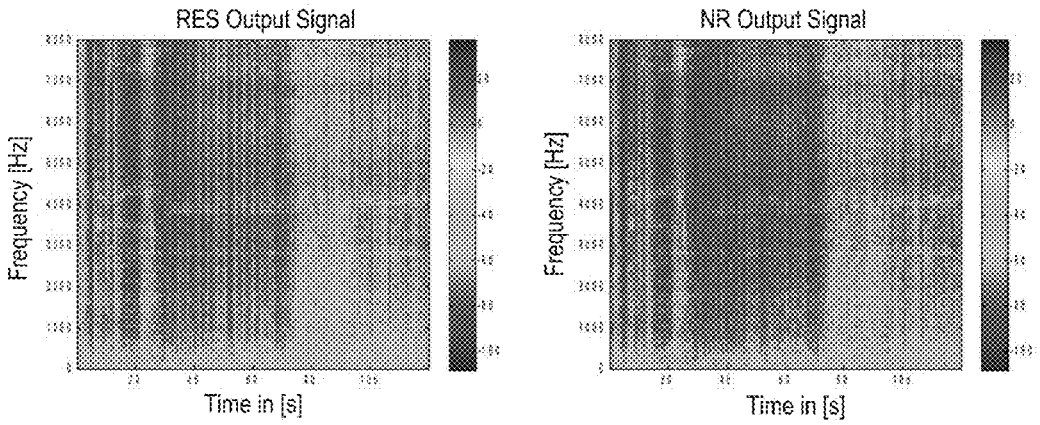
FIG. 5 shows spectrograms of the output signal of the residual echo suppression stage (on the left) and of the output signal of the noise reduction stage with a pop-noise-removal weighting mask applied (on the right).

This is also confirmed by the spectrograms of these two signals, which are shown in FIG. 5. Of course, the pop noise removal system and method disclosed herein does not need to be combined with a common noise reduction algorithm, neither it is necessary to use both the reference and the microphone signal as input signals, as only one of these signals would be a sufficient basis for this pop noise removal system and method. As such, it is clear that an upstream acoustic echo cancellation stage, with or without a residual echo suppression stage, is also not essential for a functional pop noise removal system and method.

However, the pop noise removal system and method disclosed herein may be implemented as a kind of nonlinear extension of an acoustic echo cancellation stage or an enhanced noise reduction stage, which is enabled to not only suppress quasi-stationary noise signals, but also impulsive noise signal parts. The pop noise removal system and method can be very effectively combined with common noise reduction systems and methods, thus keeping the number of MIPS and memory low when implemented in a digital signal processing environment. Beside its simplicity, it offers a very effective way to reduce impulsive parts of noise, based on the reference signal and/or the microphone signal and/or on the residual echo signal of acoustic echo cancellation stages.

A block is understood to be a hardware system or an element thereof with at least one of: a processing unit executing software and a dedicated circuit structure for implementing a respective desired signal transferring or processing function. Thus, parts or all of the system may be implemented as software and firmware executed by a processor or a programmable digital circuit. It is recognized that any system as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any system as disclosed may utilize any one or more microprocessors to execute a computer-program that is embodied in a non-transitory computer readable medium that is programmed to perform any number of the functions as disclosed. Further, any controller as provided herein includes a housing and a various number of microprocessors, integrated circuits, and memory devices, (e.g., FLASH, random access memory (RAM), read only memory (ROM), electrically programmable read only memory (EPROM), and/or electrically erasable programmable read only memory (EEPROM).

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

While various embodiments of the invention have been described, it will be apparent to those of ordinary skilled in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof.

The invention claimed is:

1. A pop noise control system, comprising:

a detector block configured to detect impulsive components in an input signal based on a signal-to-noise ratio spectrum of the input signal; and a masking block configured to generate a spectral pop noise removal mask and to apply the spectral pop noise removal mask to the input signal if impulsive components in the input signal are detected, the pop noise removal mask being configured to suppress the impulsive components in the input signal, when applied, wherein the detector block comprises:

a signal-to-noise ratio determination block configured to determine the signal-to-noise ratio spectrum of the input signal by determining signal-to-noise ratios per discrete frequency of the input signal;

a first evaluation block configured to compare within a predetermined frequency range each signal-to-noise ratio per discrete frequency to a predetermined first threshold and to provide a first evaluation output signal which is a number of signal-to-noise ratios per discrete frequency that exceed a signal-to-noise ratio threshold otherwise; and a second evaluation block configured to compare the first evaluation output signal to a second threshold and to provide a second evaluation output signal which adopts a first state if the first evaluation output signal exceeds the second threshold and adopts a second state otherwise, the first state indicating that impulsive components are detected in the input signal and the second state indicating that impulsive components are not detected in the input signal.

2. The pop noise control system of claim 1, wherein the predetermined frequency range is in total below a predetermined frequency limit, the frequency limit being representative of a minimum frequency occurring in human speech.

3. The pop noise control system of claim 1, wherein the masking block comprises a mask generation block configured to provide the spectral pop noise removal mask, the spectral pop noise removal mask being dependent on the signal-to-noise ratio spectrum.

4. The pop noise control system of claim 1, wherein the masking block comprises a mask application block configured to apply the spectral pop noise removal mask to the input signal by multiplying in a spectral domain the spectral pop noise removal mask with a spectrum of the input signal.

5. The pop noise control system of claim 4, wherein the spectral pop noise removal mask is a p-norm of a difference between one and the spectral signal-to-noise ratio.

6. The pop noise control system of claim 1, wherein the detector block is further configured to receive an additional input signal and to detect impulsive components also in an additional input signal based on a signal-to-noise ratio spectrum of the additional input signal; and the masking block is further configured to apply the spectral pop noise removal mask to the input signal only if impulsive components are detected in one or more of the input signal and the additional input signal.

7. A pop noise control method, comprising:

detecting impulsive components in an input signal based on a signal-to-noise ratio spectrum of the input signal; and generating a spectral pop noise removal mask and applying the spectral pop noise removal mask to the input signal if impulsive components in the input signal are detected, the pop noise removal mask configured to suppress the impulsive components in the input signal, when applied, wherein applying the spectral pop noise removal mask to the input signal comprises multiplying in a spectral domain the spectral pop noise removal mask with a spectrum of the input signal.

8. The pop noise control method of claim 7, wherein detecting impulsive components comprises:

determining the signal-to-noise ratio spectrum of the input signal by determining signal-to-noise ratios per discrete frequency of the input signal;

comparing within a predetermined frequency range each signal-to-noise ratio per discrete frequency to a predetermined first threshold and providing a first evaluation output signal which is a number of signal-to-noise ratios per discrete frequency that exceed a signal-to-noise ratio threshold otherwise; and comparing the first evaluation output signal to a second threshold and providing a second evaluation output signal which adopts a first state if the first evaluation output signal exceeds the second threshold and adopts a second state otherwise, the first state indicating that impulsive components are detected in the input signal and the second state indicating that impulsive components are not detected in the input signal.

9. The pop noise control method of claim 8, wherein the predetermined frequency range is in total below a predetermined frequency limit, the frequency limit being representative of a minimum frequency occurring in human speech.

10. The pop noise control method of claim 7, wherein generating the spectral pop noise removal mask comprises providing the spectral pop noise removal mask, the spectral pop noise removal mask being dependent on the signal-to-noise ratio spectrum.

11. The pop noise control method of claim 7, wherein the spectral pop noise removal mask is a p-norm of a difference between one and the spectral signal-to-noise ratio.

12. The pop noise control method of claim 7, further comprising:

receiving an additional input signal and detecting impulsive components also in the additional input signal based on a signal-to-noise ratio spectrum of the additional input signal; and applying the spectral pop noise removal mask to the input signal only if impulsive components in one or more of the input signal and the additional input signal are detected.

13. A computer device, comprising:

a processor; and a storage device storing instructions executable by the processor to:

detect impulsive components in an input signal based on a signal-to-noise ratio spectrum of the input signal, and generate a spectral pop noise removal mask and applying the spectral pop noise removal mask to the input signal if impulsive components in the input signal are detected, the pop noise removal mask configured to suppress the impulsive components in the input signal, when applied, wherein the instructions are further executable to:

receive an additional input signal and detect impulsive components also in the additional input signal based on a signal-to-noise ratio spectrum of the additional input signal, and apply the spectral pop noise removal mask to the input signal only if impulsive components in of the input signal and the additional input signal are detected.

14. The computer device of claim 13, wherein detecting impulsive components comprises:

determining, with the processor, the signal-to-noise ratio spectrum of the input signal by determining signal-to-noise ratios per discrete frequency of the input signal;

comparing, with the processor and within a predetermined frequency range, each signal-to-noise ratio per discrete frequency to a predetermined first threshold and providing a first evaluation output signal which is a number of signal-to-noise ratios per discrete frequency that exceed a signal-to-noise ratio threshold otherwise; and comparing, with the processor, the first evaluation output signal to a second threshold and providing a second evaluation output signal which adopts a first state if the first evaluation output signal exceeds the second threshold and adopts a second state otherwise, the first state indicating that impulsive components are detected in the input signal and the second state indicating that impulsive components are not detected in the input signal.

15. The computer device of claim 14, wherein the predetermined frequency range is in total below a predetermined frequency limit, the frequency limit being representative of a minimum frequency occurring in human speech.

16. The computer device of claim 13, wherein generating the spectral pop noise removal mask comprises providing the spectral pop noise removal mask, the spectral pop noise removal mask being dependent on the signal-to-noise ratio spectrum.

17. The computer device of claim 13, wherein applying the spectral pop noise removal mask to the input signal comprises multiplying in a spectral domain the spectral pop noise removal mask with a spectrum of the input signal, and wherein the spectral pop noise removal mask is a p-norm of the difference between one and the spectral signal-to-noise ratio.

* * * * *